US008024876B2

(12) United States Patent
Bettin, Jr.

(10) Patent No.: US 8,024,876 B2
(45) Date of Patent: Sep. 27, 2011

(54) GREETING CARD, 3-D SCULPTURE MODEL KIT COMBINATION, ASSEMBLY SYSTEM

(76) Inventor: Carl John Bettin, Jr., Franklin, WI (US)

( * ) Notice: Subject to any disclaimer, the term of this patent is extended or adjusted under 35 U.S.C. 154(b) by 0 days.

(21) Appl. No.: 12/655,665

(22) Filed: Jan. 4, 2010

(65) Prior Publication Data

US 2010/0186270 A1 Jul. 29, 2010

Related U.S. Application Data

(60) Provisional application No. 61/205,733, filed on Jan. 23, 2009.

(51) Int. Cl.
*A63F 9/10* (2006.01)

(52) U.S. Cl. ..... 40/124.01; 273/157 R; 206/223

(58) Field of Classification Search ..... 40/124.191; 273/157 R

See application file for complete search history.

(56) References Cited

U.S. PATENT DOCUMENTS 2,493,697 A * 1/1950 Raczkowski ..... 273/156
2,731,766 A * 1/1956 Rubin ..... 446/99
5,232,088 A * 8/1993 Leondidis ..... 206/223
5,686,154 A * 11/1997 Brown, Jr. ..... 428/15
5,988,687 A * 11/1999 Krisch ..... 281/51
7,789,392 B2 * 9/2010 Kishon ..... 273/157 R
2004/0050918 A1 * 3/2004 DeLaVergne ..... 229/305

FOREIGN PATENT DOCUMENTS

GB 2422556 A * 8/2006
JP 03244484 A * 10/1991

* cited by examiner

*Primary Examiner* — Casandra Davis
(74) *Attorney, Agent, or Firm* — Carl John Bettin, Jr.

(57) ABSTRACT

A method system for a novelty greeting card combined with an embodied 3-D sculpture model kit is contained within a postal envelope. The invention's items are at least one or more inscribed parallel planar rectangular sheets bound in dependant form to enable an open and close greeting card function. The envelope is inscribed with systematic directions to guide construction of the novelty card's embodied sculpture model kit. The card is signed by a sender including a recipient's name; said sender gives card as a gift to a recipient to apply methods of the invention's intent. As recipient deploys invention's construction system by implementing tools and parts embodied in novelty card. The sender's actual signature and recipient's name are conveyed though the method of construction and retained upon the final resulting sculpture of the invention. All construction elements, tools and parts derive solely from the planar sheets that comprise the invention.

2 Claims, 8 Drawing Sheets

FIG.4 VIEW 1 OF 1
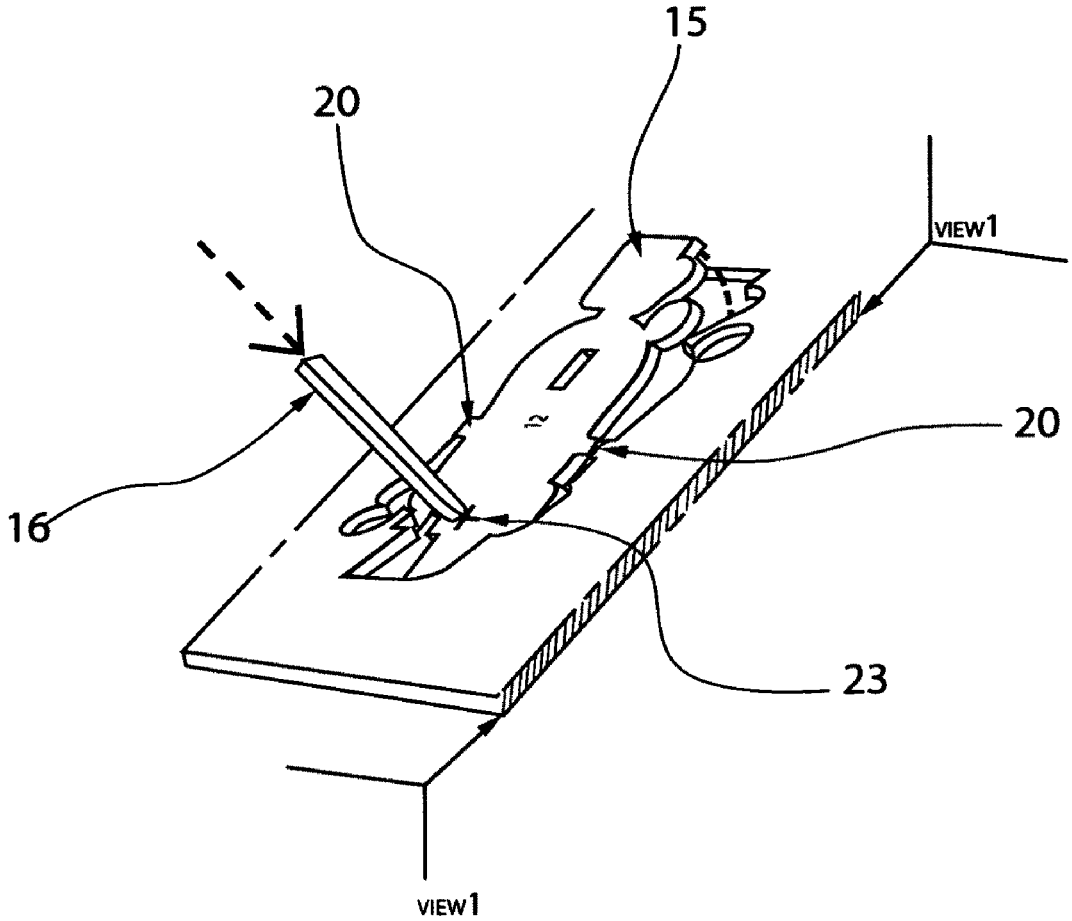
FIG.5
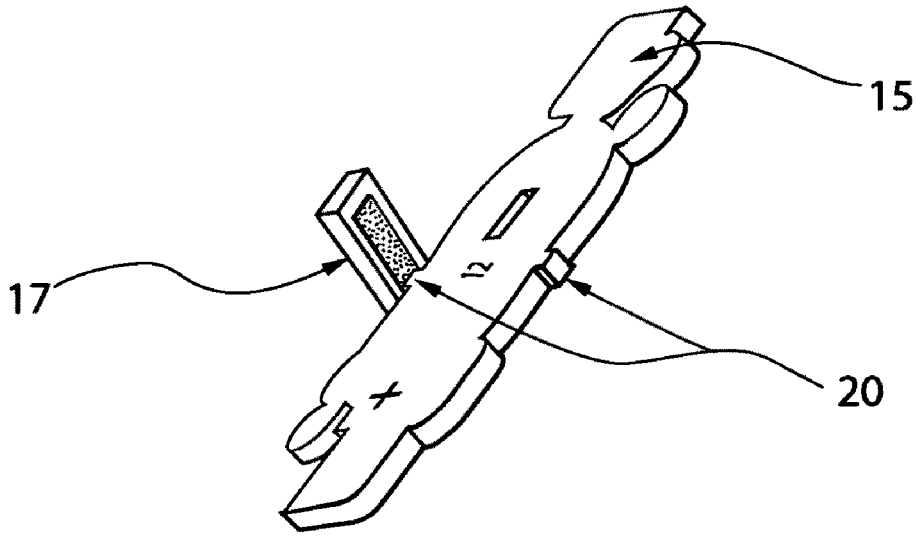

GREETING CARD, 3-D SCULPTURE MODEL KIT COMBINATION, ASSEMBLY SYSTEM

CROSS-REFERENCE TO RELATED APPLICATIONS

Alexander A Leondidis U.S. Pat. No. 5,232,088 issued Aug. 3, 1993 discloses a combination greeting card puzzle kit. The kit has a postal card laminated to an inscripted puzzle, implemented by a recipient to break and re-assemble multiple flat planar puzzle elements. This cited invention is void of a sculptured 3-D model result or bridged abeyant parts suspended in its base material. The same invention has no implementation system of tools or register key component essential to an error free sculpture construction.

D. Hesrshkovits U.S. Pat. No. 4,140,317 continuation issued on Aug. 21, 2001 discloses a puzzle of plural elements, a base and a core to be constructed into a 3-D sculpture. All elements and components of the invention are in separate independent forms, free of any mention of parts elements embodied within a postal compatible novelty card format, also free of notion of system of construction elements embodied suspended in abeyance by bridges within a postal compatible card and yet again, free on any notion of a postal envelope container inscribed with postal "fill in address" elements. Nor an envelope container inscribed with directions that deploy a break apart and put together application of the invention. This related patent is free of any notion of a novelty card embodied model kit complete with traditional model kit directions. It is also free of any notion of a use of personal inscriptions such as sender's name and recipient's name upon the elements of the sculpture which are conveyed through applied assembly of the final result sculpture as described within this invention. The related patent is also free of mention of implemental tools based, or comprised or embodied and originating from the sole material of the novelty card base material.

S. E. Bradley U.S. Pat. No. 5,743,035 issued on Apr. 28, 1998 discloses a die-cut process of a gift card that is the sole material to only fold a novelty card into a self displaying, vertical, 3-D form reliant on printed art the novelty invention will display. This related 3-D invention is free of any notion of a method or system of implementing tools and multiple parts elements embodied within the invention to construct any break apart and put together model kit that results in a three-dimensional sculpture result.

FEDERALLY SPONSORED RESEARCH AND DEVELOPMENT

Not applicable.

PARTIES TO A JOINT RESEARCH AGREEMENT

Not applicable.

REFERENCE TO A SEQUENCE LISTING

Not applicable.

BACKGROUND OF THE INVENTION

This submitted inventions field of endeavor is the giving and receiving of greeting/novelty gift cards, similar to a single sheet folded or bound in two equally dimensional panels. In addition, the card invention combines a hobby model/sculpture building system embodied within a greeting card. This card invention is applied by a sender personally inscribing a recipient's name, then giving said card within an envelope to a recipient for occasions such as birthdays and holidays. The invention's intent is for the recipient to construct/apply the card into a model/sculpture to commemorate the occasion for which it is given. The sender saves time acquiring a card and sculpture gift combined.

Once the recipient constructs the card into a model sculpture, the sender's personally signed inscriptions, e.g. signature, plus the recipient's inscribed name are conveyed though to the final result model sculpture. Hobby model kit building has always attracted people seeking "break apart put together" amusement related to creativity with their interest in design style and mechanics for the sake of renewed hobby fulfillment. This card invention allows a hobbyist and non-hobbyist to fulfill his/her cursory interest in the progression of constructing a novelty model without a huge time commitment and skill level or toxic materials. The invention's applied activity greatly enhances the sentimental value of a card, beyond the traditional birthday greeting card or such similar novelty cards.

Greeting cards and gift cards alike have always been popular gifts where packaged and wrapped gifts were less suitable due to the sender's limited yet valued relationship with the recipient. This invention gives the card sender the option to send furthermore a card that can be constructed into a novelty gift sculpture, synonymous to a two-in-one physical gift item.

This invention can fit within a broad field of possibilities. In cases where the recipient is a child or young adult, the invention can include certain additional educational inscriptions revealed through the construction procedure of the model sculpture allowing means to further general knowledge along with an initial cursory action toward mechanical arts. The card can also have physical therapy applications to rehabilitate disabilities of "finger dexterity" and coordination, plus an implementation for learning braille. Public municipal schools can form a curriculum taking the phases of the inventions development to teach current design and art skills, engineering processes and math, file optimization, technical writing, basic machining and manufacturing. These are great possibilities for a real, hands-on, interesting and fun course for students wanting to learn. Due to technology advancements, such a course around the system and method of this invention could be far more affordable than before.

BRIEF SUMMARY OF THE INVENTION

The presented invention, a greeting card combined with a planar model sculpture system or "kit", is disclosed.

Therefore, the object of the present invention, the primary item, is classed as an inscripted novelty card embodied with a provisional sculpture model kit contained in a postal envelope.

Another object of the present invention is the card's embodied sculpture kit is comprised of planar parts and tools fixed in abeyance and suspended by bridges within the novelty card. The card is one solid element that a recipient will break into several subsequent elements.

Another object of the invention is to provide a novelty card and sculpture model kit combination upon which a card sender may inscribe their personalized signature and the name of the recipient upon any planar parts suspended within the novelty card and sculpture model kit combination.

Yet, another object of the invention is the assembly method or directions are inscribed on the novelty card postal envelope. The recipient of the novelty card and sculpture model kit combination applies printed directions for a method and system of assembly for the card's embodiment of tools and parts by breaking bridge-suspended model parts from the card and deploying a procedure of sculpture assembly. Organization of the kit and process is simplified by inscribing the assembly directions on the envelope, which guide an error free construction.

An additional object of the invention is the sender's personalized inscriptions upon a select part, which maintain intended conveyance through the assembly method. When the aforementioned assembly of sculpture is completed, the sender's personalized inscriptions are visible on the resultant sculpture.

Still another object of the invention is all embodied elements of the novelty card sculpture kit combination derive from a base sheet of consistent fixed gauge materials. Select materials such as wood, metal, plastic and paperboard are the sole materials to comprise all construction elements of the novelty card sculpture kit combination (barring only the abrasive swatch or sandpaper and envelope). Or, all sculpture construction elements and implements derive and materialize from the novelty card's base material. This offers a benefit of fewer materials for the invention.

Yet, another object of the invention is the implementation system of tools embodied by bridges in the novelty card. The tools are a parts release tool and a finishing tool.

Another object of the invention includes marked push tool points, located when required on individual planar parts to safely release parts at a specific location of individual shapes. This assures parts are not broken as card recipient extracts parts from the Greeting Card Sculpture Model Kit (collectively "GCSMK").

Still another object of the invention is the envelope container printed with inscriptions of directions for a systematic assembly method of novelty card sculpture kit and citation picture of novelty card model design. Also marking lines for fill-in postal addresses and delineation of stamp position. The envelope provides a the multi-purpose of postal envelope essentials and presenting the specific design of the cards result sculpture and assembly instructions.

Another object of the invention is the register key to which the planar construction parts are assembled onto. The key is of the same gauge as the planar parts. Planar parts are horizontally gauged i.e. 1/16" height on Y-axis and loaded on a vertically stationed register key that is a 1/16" deep on Z-axis. All parts can only originate from the gauge of the novelty card that hosts the embodied novelty card sculpture kit.

Another object of the invention is the planar parts are inscripted with educational statements that are relative or themed in accordance with the sculpture design i.e.: a novelty card sculpture design of a cat will include at least one or more planar parts inscribed with at least one or more educational facts about cats. A card recipient may learn about topics of the sculpture subject and also experience a revelation of various construction styles or techniques.

Another part of the invention is the Question and Answer System assembly method for the novelty card sculpture model kit. Directions dictate a starting planar part with a trivial question inscripted upon it. An applicant seeks out its unshared answer that will be found on the next sole planar part that is required for the proper assembly of the final result sculpture of the GCSMK. This continues through the entire assembly.

Another part of the invention is the Numerical method system of assembly for the GCSMK to which the planar parts are assembled by inscriptions of typical Arabic numerical ranking e.g.: Part 1 followed by Part 2 and so on. The system provides an error-free assembly.

A final object of the invention is no adhesive for card apparatus. The planar parts are fixed non-reliant on gravity. Without optional adhesive, the sculpture can be held omnidirectional and not fall apart. Programmable accurate machining allows an interference fit and omits the use of chemical adhesive.

BRIEF DESCRIPTION OF THE SEVERAL VIEWS OF THE DRAWING

FIG. 4 is a trimetric view of the parts release tool implemented upon a parts push point to break a planar part from abeyance from the part bridges that suspend planar part of the novelty card.

FIG. 5 is a trimetric view of the parts finishing tool implemented upon of parts residual bridge to smooth the parts edge to a smooth continuous shape.

FIG. 6 is the base and register key detailed with dot marks for the delineation of error-proof positioning. FIG. 6*a* illustrates the same register key set and ready for the subsequent parts to be inserted upon the key. The keying features and their varied features are dependent on the form of the novelty cards resulting sculpture.

FIG. 7 is an example of the numerical sequence, and FIG. 7*a* is an example of the Question and Answer assembly method.

FIG. 9A is a perspective top view of a completed resulting sculpture showing the sender's typical personalized inscriptions that are conveyed through the assembly process and are retained upon the final resulting sculpture.

DETAILED DESCRIPTION OF THE INVENTION

Figure 1:
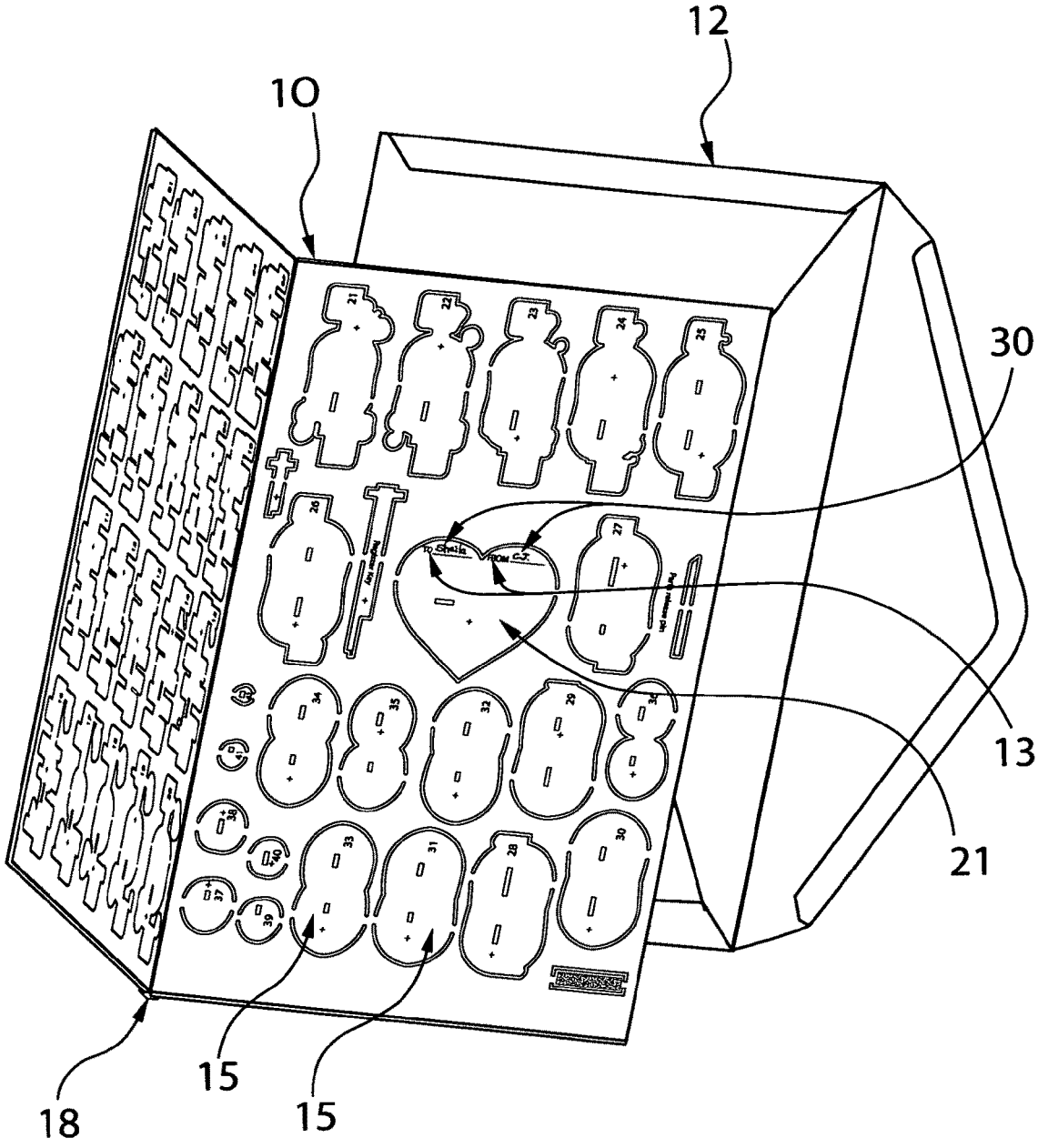
FIG. 1 is a complete trimetric view of the elements of the presented invention: GCSMK removed from envelope prior to use by recipient. Card of fixed gauge displays a sender's typical, personalized inscription.

Referring to FIG. 1 of the drawings, the isometric view of the presented invention will be identified as a system of two items, the Greeting Card Sculpture Model Kit 10 and a postal envelope 12. The novelty GCSMK is a greeting card incorporated or combined with an embodiment of a model or sculpture kit assembly system. The envelope 12 is a postal compatible container inscribed with model kit assembly method instructions (not shown). These presented elements of the invention may or may not include a wrapper or container for further packaging (not shown) for optional means of protective transmittal of the invention's components.

In general, a GCSMK 10 is comprised of at least one planar rectangular fixed gauge base element or sheet of wood, plywood, wood fiber, and or foam core composite products, metal or plastic and plastic composite materials. A large single sheet used for manufacturing may contain at least one score to form at least one hinge from a suitable material so that the individual sheet may be folded in half or multi-folded to form multiple equally dimensional panels. The presented novelty card 10 is depicted with two bound planar sheets with slot and cut features completely through the card base sheets. This invention may or may not be bound in dependant form adjoined to apply an open and close function similar to a book. The method of binding a plurality of sheets, as depicted in FIG. 1 is with a bindery tape 18 or strip with light adhesive along one side of both sheets. This binding method of a plurality of sheets is applicable dependent upon the amount of card sheets, material and gauge of such sheets for this invention. When more than two sheets are bound, such composite may or may not use a tri-fold or quad-fold. All following examples and descriptions of the presented invention will be directed at the configuration of a wood, two-sheet, bound GCSMK combination with a single envelope container. Also, this GCSMK can embody an unlimited amount of sculpture design possibilities and feature a colorized or phosphorescent manufacturing finish technique. Also, may include features of government approved batteries, tape batteries, solar cells, LED lights, powered fiber optic lights, springs, applications of glitter, clear finishes and any micro audio electronic device.

Overall, in FIG. 1, the invention is in order of how a sender will begin to apply the GCSMK before giving it to a recipient. Typical to gift cards or greeting cards alike, the sender removes the novelty card from the envelope container 12, opens card, and signs both their personalized signature 30 and a recipients 30 name on the featured "To and From" gift inscriptions 13 fields or blank lines. The gift inscriptions 13 of the invention are inscripted either on a featured sculpture model kit break away part 15 or the featured themed sculpture base 21 embodied within the card sheets of the GCSMK.

No known application or issued patent combines a novelty or greeting card embodied with the elements and features of a sculpture model kit. Further statements of the novelty card's system, personalized inscriptions, inscripted sculpture model parts, accurate manufacturing and its relation to the card recipient and invention will follow below.

Figure 2:
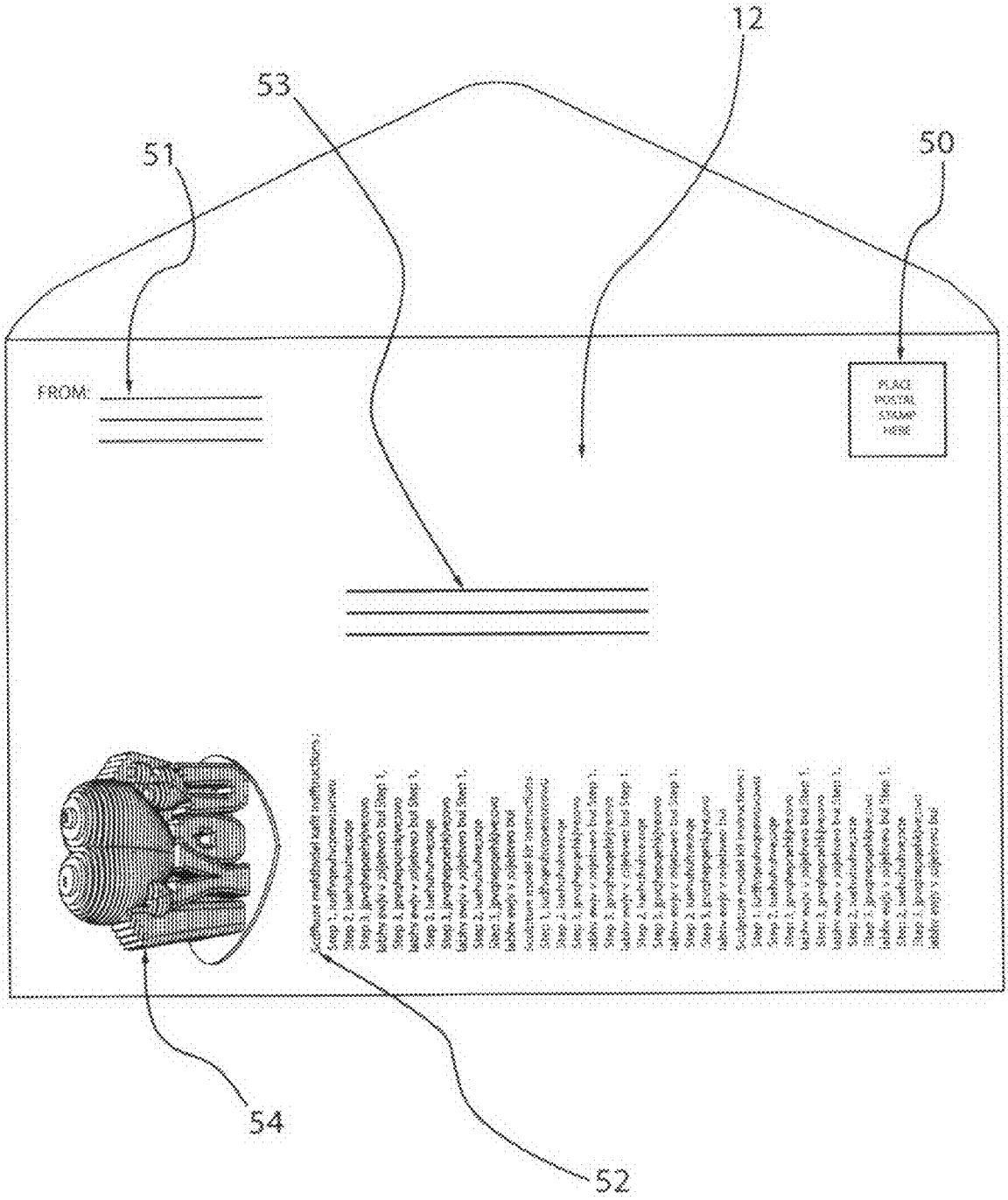
FIG. 2 is a plan view of the postal envelope with inscripted instructions and a representative illustration of the cards specific sculpture design. It also includes traditional postal envelope markings.

FIG. 2 is a plan view of the front of an open novelty card postal envelope 12. The envelope provides a container for transmittal of the GCSMK. Transmittal from sender to recipient can be done through the federal postal service. The envelope of this invention may or may not include inscripted printed elements upon the exterior or interior surface of the postal envelope. Such elements are printed and comprised of:

(1) A printed stamp location box 50 for the postal stamp/s placement
(2) The inscribed box to delineate a spot for sender to apply a postal stamp without inhibiting additional printed elements
(3) Recipient address lines 53 intended for the card sender to fill in the card recipients postal address inscriptions
(4) Sender return address lines 51 prefaced with a "FROM:" inscription
(5) Sculpture kit model assembly instructions 52 (depicted in FIG. 2 as nondescript text) direct the card recipient to apply an assembly method or guidance system through an error-free construction activity of the GCSMK. The instructions prefigure a method for the recipient to detach a parts release tool and then use the independent release tool to subsequently remove all GCSMK elements and planar parts. These instructions guide a recipient through a method to implement GCSMK tools and proceed to further instructions related to parts rank, inventory numbers, dot markers and specific suggestions encompassing all characteristics of the assembly method system to fully construct an error-free build of the GCSMK. Said instructions may or may not be separately printed on a detached piece of paper (not shown).
(6) A printed visual illustration 54 of the sculpture model design to provide the sender the ability to choose from a variety of available GCSMKs. It also provides the card recipient a visual illustration of the GCSMK's resultant sculpture after the cards assembly method and system have been applied
(7) An adhesive seal (not shown)
(8) Inscriptions for child safety and additional dependent inscriptions (not shown), not limited to the above statements for FIG. 3

Figure 3:
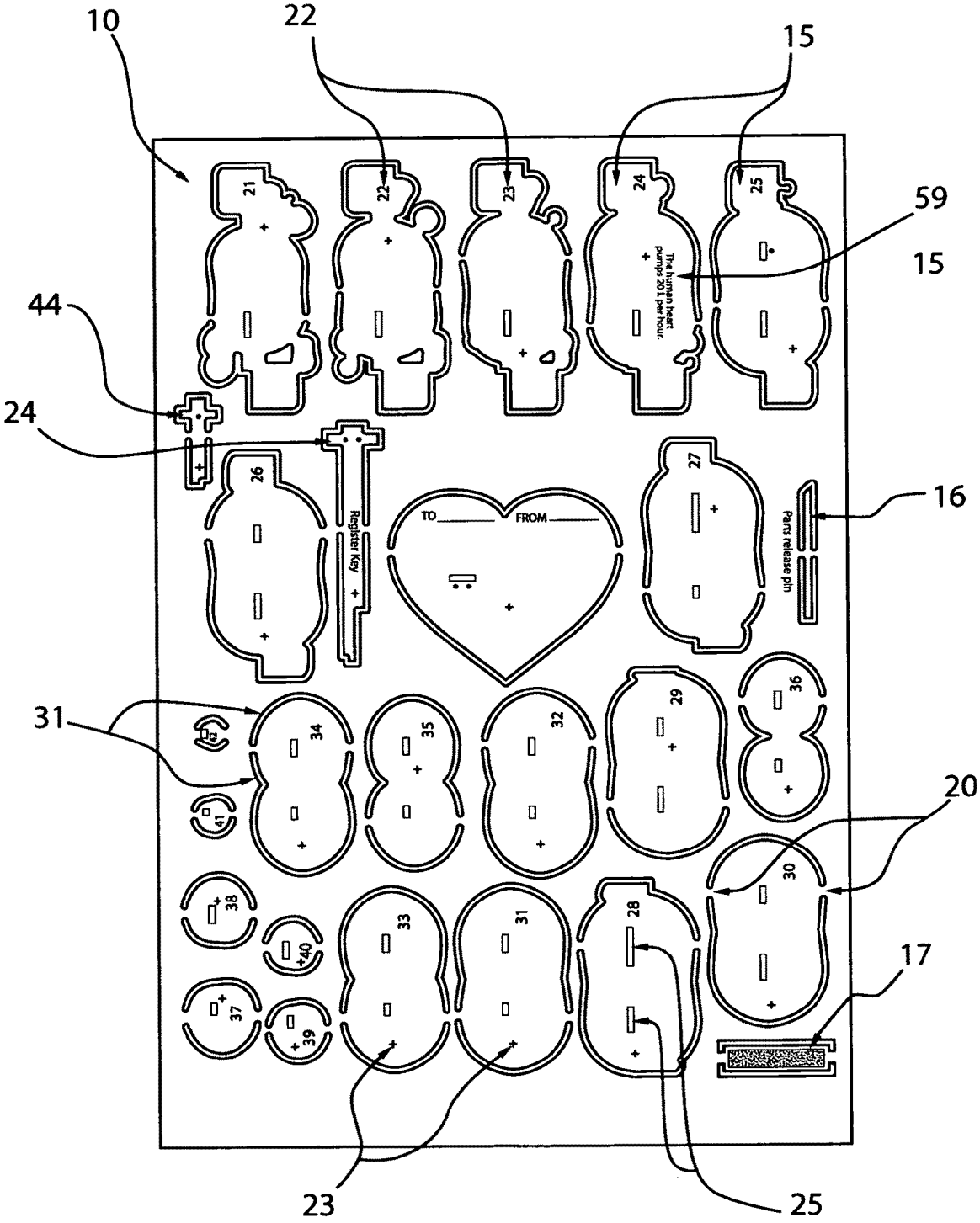
FIG. 3 is a close up section of a plan view of half of the presented GCSMK and its embodied cut sculpture elements, inscriptions and abeyance features.

Referring now to FIG. 3 is a plan view depicting more detail of a single sheet or half of the GCSMK. The representative GCSMK half sheet is embodied with elements or components of a construction system of tools, planar parts and inscriptions upon planar parts for both inventory and a relative guidance system. Methods of parts construction are deployed by the recipient with printed envelope instructions and card elements to construct the novelty card's intended sculpture. These novelty card components or elements are not limited to but are comprised of:

(1) A plurality of bridge suspended, breakaway sculpture parts 15
(2) A set of two parts bridges 20 between cutting slots 31 to suspend each part or tool in abeyance
(3) A register key 24
(4) A secondary register key 44; and parts slots 25, to enable each part to fit on register keys; and inscribed parts numbers 22, to rank the assembly order and inventory each part
(5) A parts release tool 16 bridged and suspended in card
(6) Push point 23 inscriptions, implied contact points for parts release tool
(7) A finishing tool 17 bridged and suspended in card Also, there are various inscriptions embodied on the representative card half, described as:

(1) A sender's and recipient's personally inscribed names 30 (see FIG. 1); wherein:

(a) before GCSMK transmittal to recipient, parts are inscribed by sender upon gift inscription 13 (see FIG. 1) fields printed on the themed sculpture base or any planar part (2) And more so, various specifically placed inscriptions of:
(a) Educational inscriptions 59 specific information related to the specific sculpture theme or design
(b) Names of tools
(c) Register key 24/secondary keys 44 markings to define the specific key Model parts 15 and tools 16 & 17 and all other construction elements are embodied and suspended within the novelty card or sheet as a result of manufactured step cuts or cutting slots 31. The cutting slots 31 yield a group of individual contoured parts suspended by abeyant bridges 20 within the card sheet ready to be broken or released with tools by the recipient. The bridges 20 for each suspended part 15 are implemented by means of two manufactured cutting slots 31.

These cutting slots 31 are manufactured in contour to form a bridged sculpture specific part. The planar part with bridge points 20 will eventually be broken from abeyance and released from novelty card by the card applicant and the release tool 16. The manufacturing implementation to produce cutting slots 31 that forms suspension bridges for each specific part are described as:

Each contoured part requires a path or loci which defines a start point for an implemented step cutting process. This path cutting is directed along the programmed loci contouring the periphery of the planar part to be compatible with the requirements of the sculpture design. To achieve suspension of a contoured part within the novelty card sheet, the work of the cutting tool is retracted for a given distance (not cutting) and then resumes or continues (cutting) with its programmed loci, thus leaving behind an uncut area or leaving behind an abeyant bridge between the base sheet and the part. This process suspends the planar part within the card sheet until the card recipient applies the method of releasing the part from the novelty card.

Manufacturing means for path cutting methods are and not limited to the above programmed co-axial rotational cuts, but can include punch die cuts, laser cutting and etc. No known novelty cards or sculpture puzzle applications claim the abeyance of break away sculpture parts embodied in a novelty card format for mailing with personalized inscriptions or breakaway parts embodied within a dedicated fixed gauge sheet material.

FIG. 4 presents a close up partial view of an independent parts release tool 16 giving directional force applied at a push point 23 cross inscription or "X" 23, marked upon an abeyant suspended planar part 15 being released from the GCSMK base sheet. The "push point" inscription is both:

(1) A location to best alleviate parts damage. The push point 23 delineates a point of contact where the recipient positions the parts release tool 16 to break the abeyant bridged planar part 15 from the card. Considering the unlimited possibilities of part shapes, hypothetically, a shape can have a weak or vulnerable cantilever feature that is delicate due to the sculpture parts' integrity to the sculpture model design. This push point along with the parts release tool primarily guarantees proper, undamaged parts release from the GCSMK base sheet.

(2) A location for optimal torque on the planar part for release. This best select location for the push point 23 will provide the push tool a position of contact by applying directional force for the best leverage on the planar part to rotate and break about the abeyant parts bridges 20.

No known novelty card patent or sculpture puzzle includes a tool for releasing abeyant parts from a base material, let alone a system of inscriptions for a subject to position said tool to safely remove a suspended part without damage from a greeting card of fixed gauge.

FIG. 5 presents a close-up, isometric view of a planar part 15 that has been completely removed from the novelty card and the finishing tool 17, which also has been removed from the GCSMK base sheet. Immediately after removal from the novelty card, a planar part has two residual broken parts bridges 20, tabs or nubs on the edge of the planar parts' outer edge or periphery. These nubs are leftover halves of the former part bridges 20 from the base sheet that still remain on the planar part. In order for the recipient to achieve a sculpture with the best visual result, the recipient removes the remaining former bridge nubs with the finishing tool. The recipient breaks the finishing tool 17 from the novelty card, which is laminated with a sandpaper swatch adhered to it. When following the envelopes instructions, the recipient holds the finishing tools' sandpaper face to a residual nub and reciprocates or rubs the finishing tool against the nub, similar to the manner of a sanding block procedure until the nub is completely removed. Also, given the possible variety of the card's base sheet material certain composite wood fiber products may require the recipient to implement a hobby razor knife or file with or without conjunction of the finishing tool to achieve the proper finish to the planar parts edge. Proper finishing instructions or implements for any specific base sheet material may or may not be included in the envelope instructions or embodied in the card sheet material or placed within the envelope. The GCSMK guidance system will declare any additional required components dependent upon the specific GCSMK's assembly method and construction system.

No known novelty card patent or sculpture puzzle includes an embodied sandpaper swatch tool for finishing or smoothing breakaway parts for enhancing the appearance of a completed sculpture model assembly.

Figure 6:
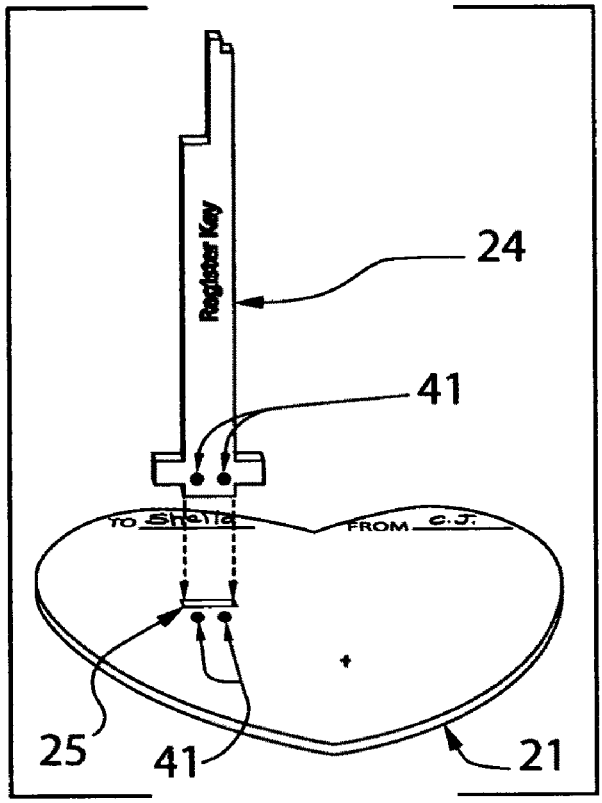
FIG. 6 & FIG. 6*a* both present two views of match.

FIG. 6 is an exploded view illustrating the dot marked registration key oriented to be inserted into the themed base. This view contains:

(1) Dot marked 41 register key 24 and its orientation to the dot marked 41 themed base 21. The matching dot marks 41 delineated on both the register key and themed base to prevent the recipient from inserting the fixed gauge register key into themed base's planar part slot 25 backwards.

Figure 6A:
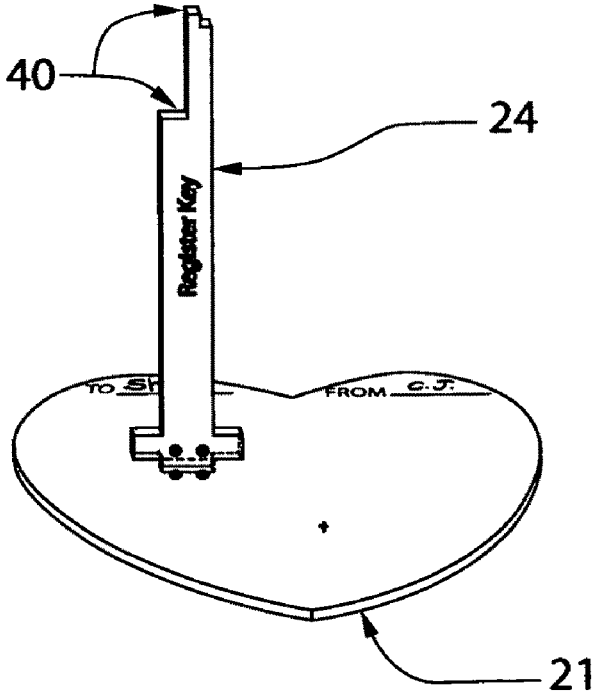

FIG. 6*a* depicts the register key 24 after the applicant has fully seated the key into the themed base 21. The register key includes a sculpture specific shape or keying features 40. It is secured by an interference fit between the register key 24 and the themed base 21. The accuracy of the interference fit is achievable by a preferred programmable matching process manufactured upon a variety of materials. This invention manufacturing process is not limited to a programmable matching process.

Figure 7:
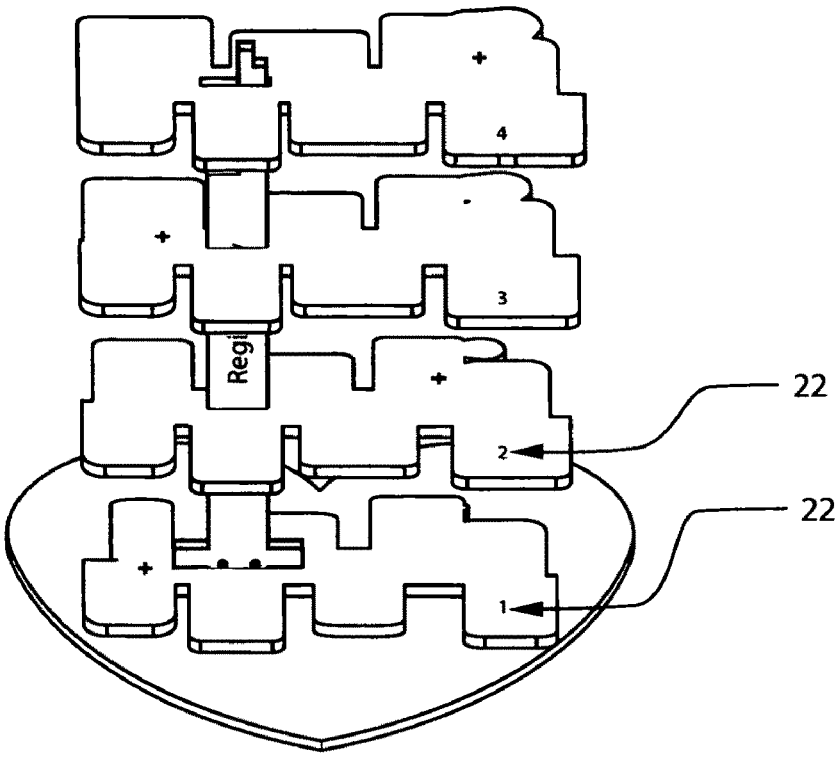
FIG. 7 & FIG. 7*a* are both exploded views of parts displaying the two separate assembly method systems.
Figure 7A:
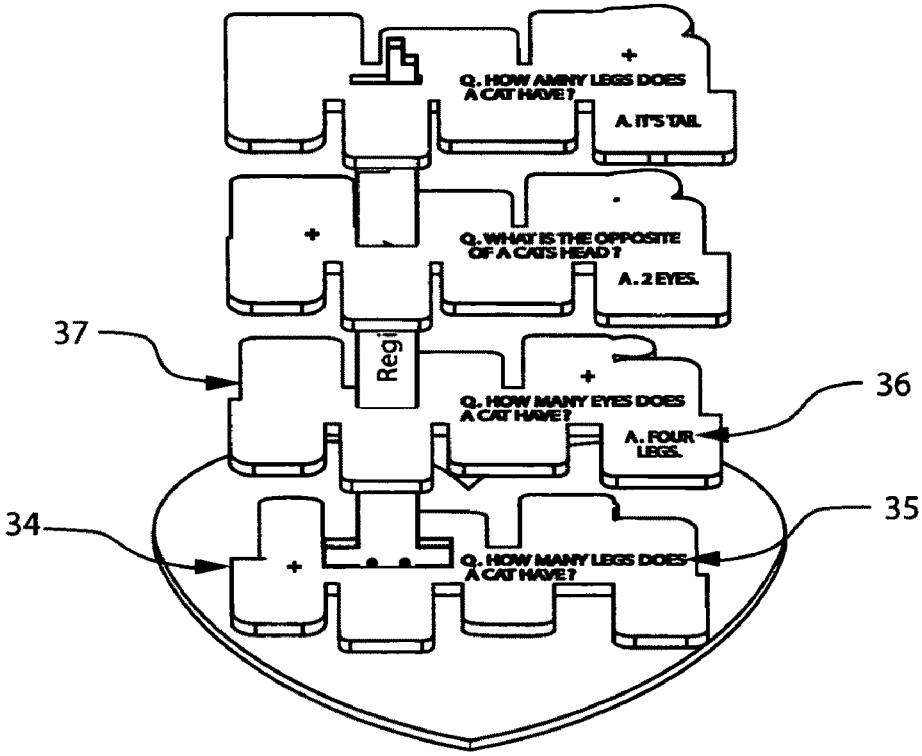

FIGS. 7 & 7*a* depict two separate exploded views, each of a base and erected register key with a partial assembly of four planar parts upon the primary register key. Dependant upon GCSMK specific instructions, the card recipient may or may not use at least one of the two separate stacking procedures for a single GCSMK assembly. Numbers may function both as basic inventory reference guide and a stacking sequence for ranking assembly for a variety of assembly method possibilities of any GCSMK.

FIG. 7 has sufficient information to depict a numerical stacking sequence procedure. FIG. 7*a* has sufficient information to depict a Question and Answer (collectively "Q and A") stacking sequence procedure.

Within both FIGS. 7 and 7*a*, each separately presenting planar parts printed with either a numerical marking (FIG. 7) or "Q and A" sentence markings (FIG. 7*a*).

Either of these two stacking procedures may be combined or separate within a kit, as the area on small parts are not adequate for question and answer markings.

These markings along with envelope instructions guide a recipient through an assembly procedure. These assembly procedures are described as:

(1) A numerical ranking procedure FIG. 7, wherein every planar part bears a number 22. The numbered part is to be stacked sequentially in ascending order upon the register key. The first part on the key may not start with the number one, but the numerical assembly method is always in and of ascending order.

(2) The "Q and A" assembly method FIG. 7*a*. The "Q and A" assembly method is a trivial amusement system of questions and answers whereby a recipient is challenged to properly answer questions to progress though a correct sculpture assembly procedure. The "Q and A" assembly method is comprised of questions and answers marked on individual planar parts.

(3) A marked "Q." preludes an individual parts question and a marked "A." preludes the parts answer. To begin the process, the recipient utilizes the envelope instructions to define a starting planar part 34 for the "Q and A" process. The predefined starting planar part has only (barring a push point tool) a question or problem 35 marked upon it for the card recipient to solve.

(4) To solve the question the recipient ascertains the correct answer and finds the correct answer 36 inscripted upon the next planar part 37 required to properly sequence the assembly of the sculpture model.

For any reasons beyond the previous description, parts itemized by numbers for proper ranking toward a correct build, may also be included or mixed within the "Q and A" assembly method.

Both the numerical and Q and A assembly procedure are not limited only to the ranking methods previously mentioned and cover any and all known synonymous, characters of numerical rankings and text in all known languages and any accepted symbolism, binary coding and bar coding.

Figure 8:
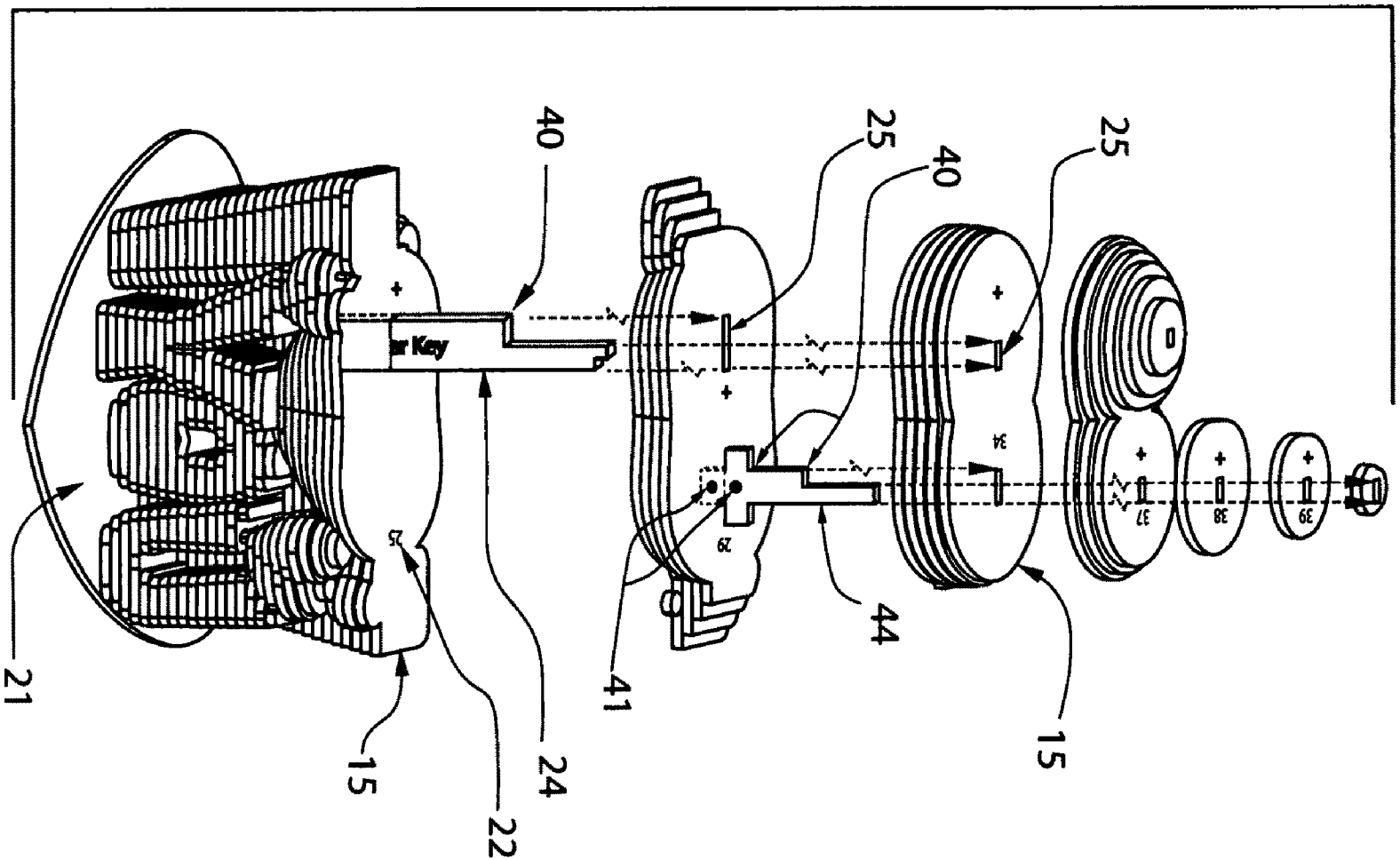
FIG. 8 is an exploded view of the entire sculpture, the register key and the secondary key, with relationship of keying features and sculpture form.

FIG. 8 is an exploded view to depict the assembly of register keys, themed base 21 and ranked planar parts. Following the process of FIG. 6*a*, an applicant guided along with the inscripted envelope instructions, applies the numerical inventory of ranked parts FIG. 7. The number ranking inscriptions 22 upon the planar parts 15 provides a numerical sequential order for the card applicant to properly place the planar parts. On each part is a slot; the planar part slot/s 25 dimensions match to the varied corresponding shape or configured keying features 40 of the registration key 24 and secondary register key 44. This keying feature and slot match prevents improper assembly of the sculpture, assisting the applicant in a go or no-go progression through the sculpture construction.

A distinction of the invention is all parts are embodied within a fixed gauge sheet and dictates all tools and constructible card elements to derive from sheet of consistent gauge or thickness. The fixed gauge characteristic upon all card elements is not cited within any relative patents. The accuracy of the optional programmable machining offers interference fit that is consistent in quality for high volume manufacturing of the invention. No other cited inventions have claim to a committed consistent fixed gauge dimension base upon a host sheet material dedicating the registration key or base core to the same fixed, constant thickness, dictated by the inventions sheet material.

The register keys also offer stabilization of the sculpture. The numerical ranking can be ascending or descending revealed to card applicant per the instructions.

Figure 9:
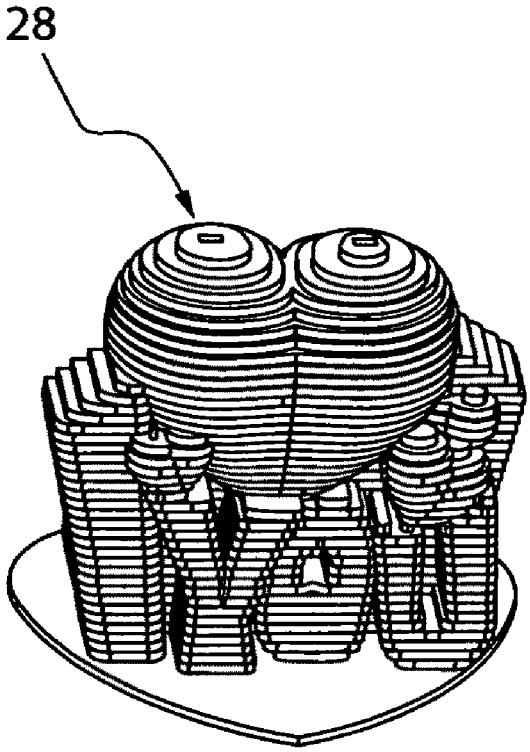
FIG. 9 & FIG. 9*a* FIG. 9 is the resulting sculpture of the GCSMK assembly system.
Figure 9A:
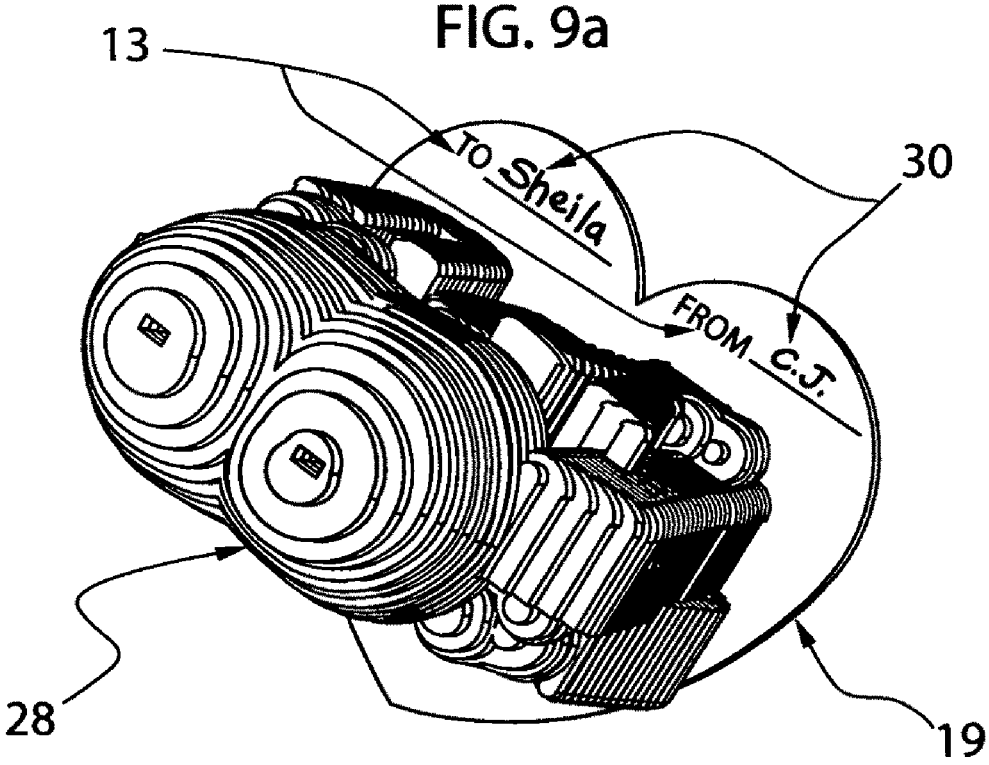

FIG. 9 presents a perspective top view of the completed resulting sculpture 28 after the recipient has applied the GCSMK's tool system and assembly methods. FIG. 9*a* presents the sender's personalized inscriptions 30 upon the final resulting sculpture completed by the card recipient. The GCSMK sender's signature 30 and recipient's name 30, written upon the "To and From" gift inscriptions 13 and "fill in" blanks, have conveyed through a GCSMK's assembly method, and are imparted upon the thematic base thus retained upon the final resulting sculpture. This complete conveyance of the personalized inscriptions bestows the personalized sentimentality of a traditional greeting card signature upon an actual gift. it is a recipients transformative gift or a "two-in-one" gift from the sender

I claim:

1. Greeting card sculpture model kit comprising:

a planar blank having a first and second surface, wherein the blank further comprises:

a base piece with a slot formed therein, indicia on one surface thereof, and an area free of indicia for receipt of inscription;

a register key piece;

a piece release tool; and a plurality of various shaped sculpture pieces, wherein each sculpture piece has a slot formed therein;

wherein the base piece, register key piece, release tool and the sculpture pieces are die cut from the blank and releasably attached to the blank by a pair of bridge members such that once the release took is removed from the base piece, the release tool can be used to facilitate the removal of the base piece, register key piece and the sculpture pieces;

once released from the blank, one end of the register key piece can be inserted into the slot of the base piece such the register key is perpendicular to the first surface of the base piece, such that the sculpture pieces can then be stacked onto the base by inserting the register key through the slot of the sculpture piece to form a three-dimensional sculpture.

2. The greeting card sculpture model kit of claim 1, wherein the blank further comprises a finishing tool die cut from the blank and releasably attached to the blank by a pair of bridge members, wherein the finishing tool aid in removing nubs left when the sculpture pieces are removed from the blanks.

* * * * *